US008316472B1

(12) United States Patent
Martin

(10) Patent No.: US 8,316,472 B1
(45) Date of Patent: Nov. 27, 2012

(54) SWIVELING TOILET SEAT DEVICE

(76) Inventor: Robert C. Martin, Vienna (CA)

( * ) Notice: Subject to any disclaimer, the term of this patent is extended or adjusted under 35 U.S.C. 154(b) by 437 days.

(21) Appl. No.: 12/553,940

(22) Filed: Sep. 3, 2009

(51) Int. Cl.
*A47K 13/00* (2006.01)

(52) U.S. Cl. ..... 4/239; 4/235; 4/254

(58) Field of Classification Search ..... 4/235, 237, 4/239, 254
See application file for complete search history.

(56) References Cited

U.S. PATENT DOCUMENTS 4,080,671 A 3/1978 Stähli
4,944,058 A * 7/1990 Carnahan et al. ..... 4/239
4,951,328 A 8/1990 Potvin
D372,766 S 8/1996 Francke
6,018,825 A 2/2000 Enomoto
6,868,561 B1 3/2005 Myers
7,155,748 B2 1/2007 Vierkant, III et al.

* cited by examiner

*Primary Examiner* — Tuan N Nguyen

(57) ABSTRACT

A swiveling toilet seat device for attaching to a rim of a toilet bowl comprising a toilet seat-shaped first base pivotally attached to the back of the rim of the toilet bowl; a toilet seat-shaped second base disposed above the first base, wherein a plurality of wheels extend from the bottom surface of the second base and fit into a track disposed in the top surface of the first base; wherein the second base can rotate in a first direction and second direction atop the first base.

3 Claims, 4 Drawing Sheets

SWIVELING TOILET SEAT DEVICE

FIELD OF THE INVENTION

The present invention is directed to a toilet seat, more particularly to a toilet seat that swivels.

BACKGROUND OF THE INVENTION

Elderly individuals or disabled individuals may have difficulty maneuvering on and off a toilet seat. The present invention features a swiveling toilet seat that can be attached to a toilet bowl. The toilet seat swivels, allowing a user to twist or rotate while sitting on the toilet. This may provide comfort and convenience to the user. This invention will help with transfers to a tub, wheelchair, walker, etc.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
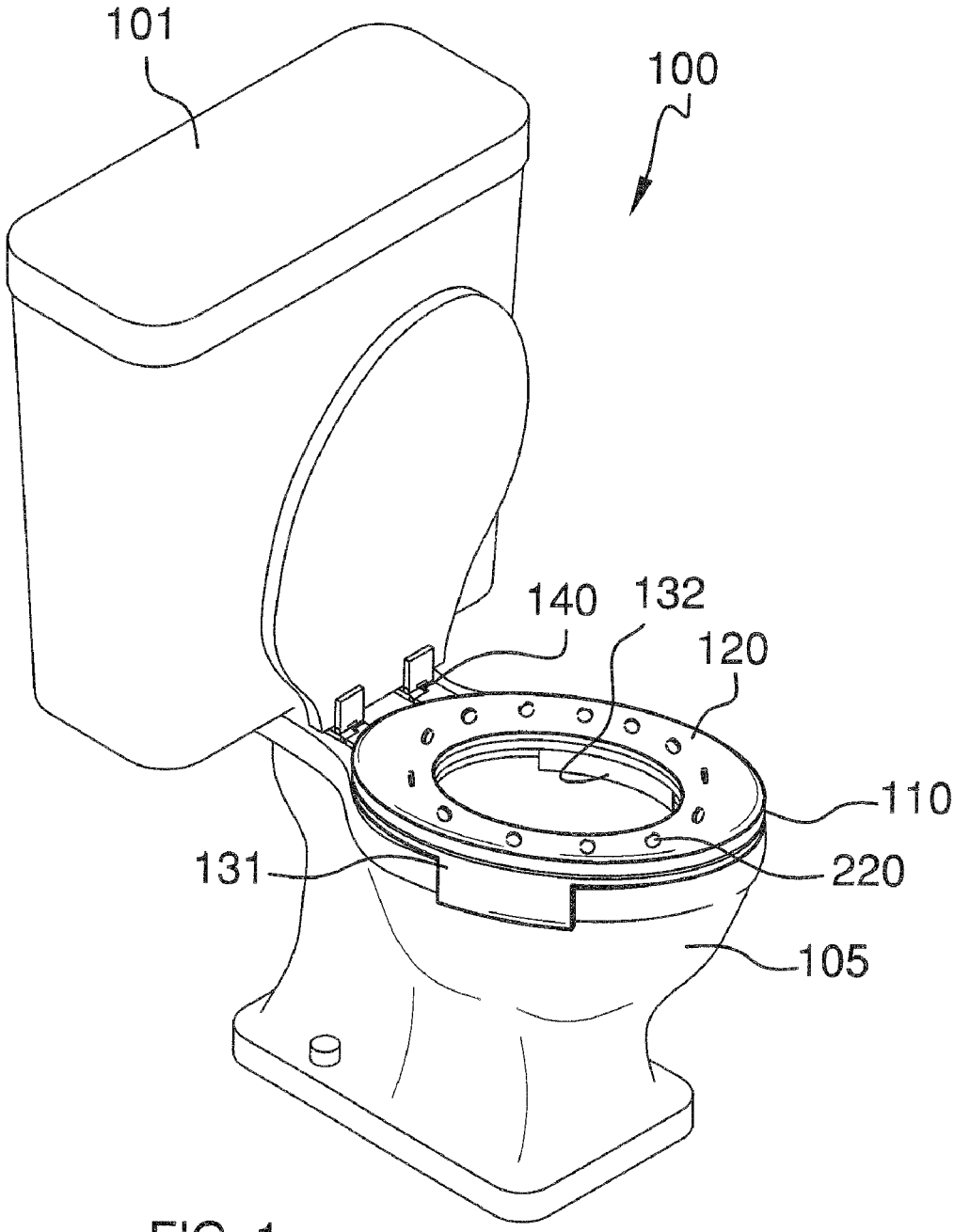
FIG. 1 is a perspective view of the toilet seat device of the present invention.
Figure 2:
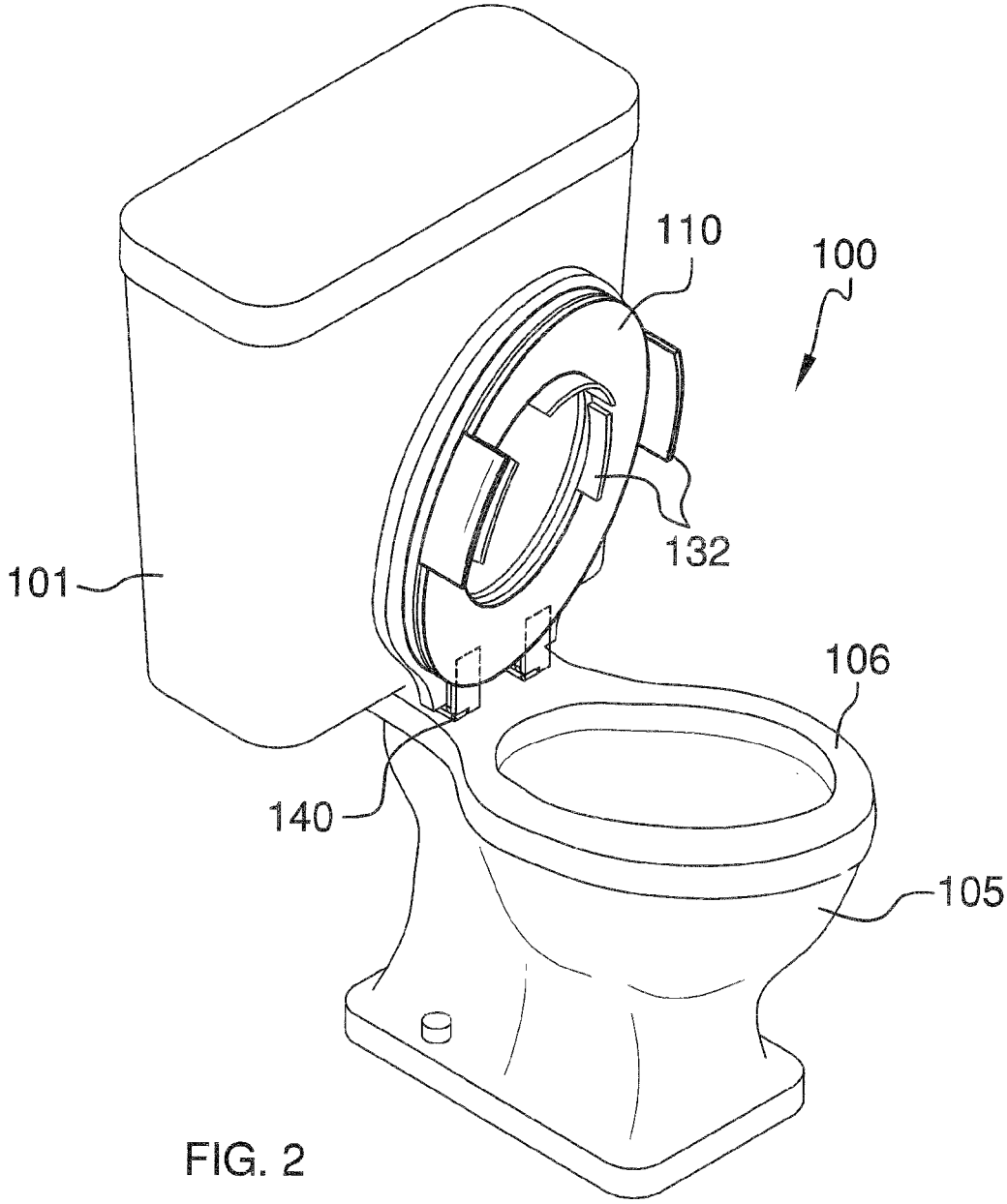
FIG. 2 is a perspective view of the toilet seat device of FIG. 1.
Figure 3:
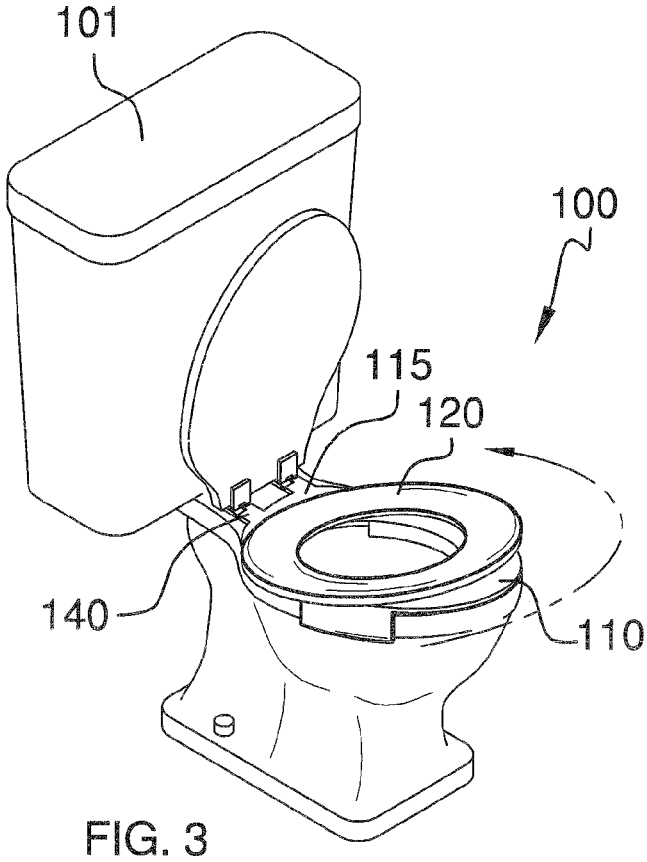
FIG. 3 is a perspective view of the toilet seat device of FIG. 1, wherein the second base can rotate atop the first base.
Figure 4:
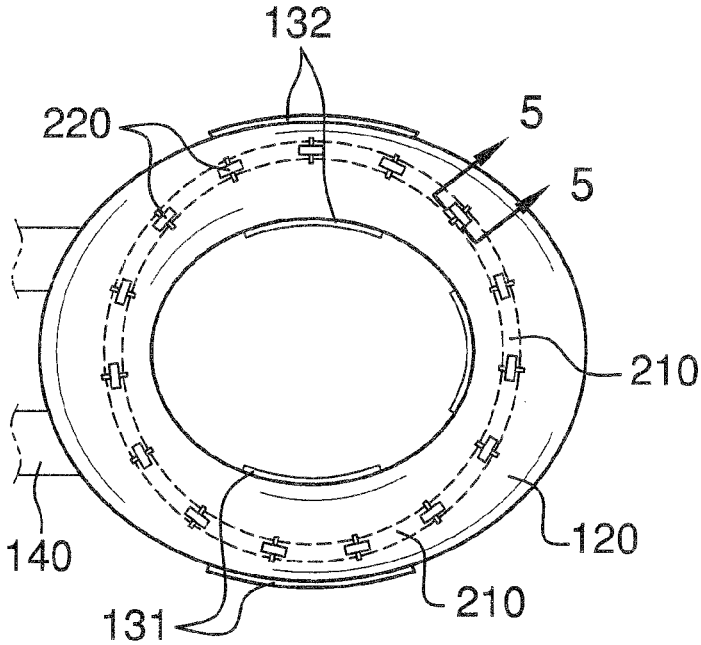
FIG. 4 is a top and internal view of the toilet seat device of FIG. 1.
Figure 5:
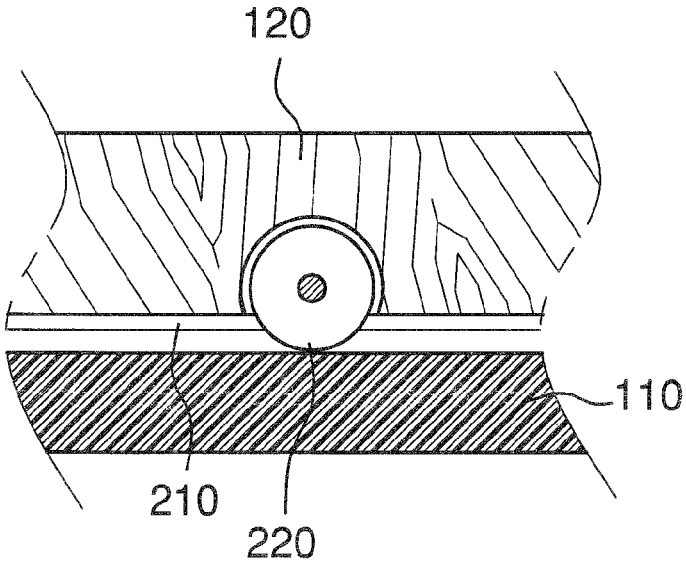
FIG. 5 is a side cross sectional view of the toilet seat device of FIG. 1.
Figure 6:
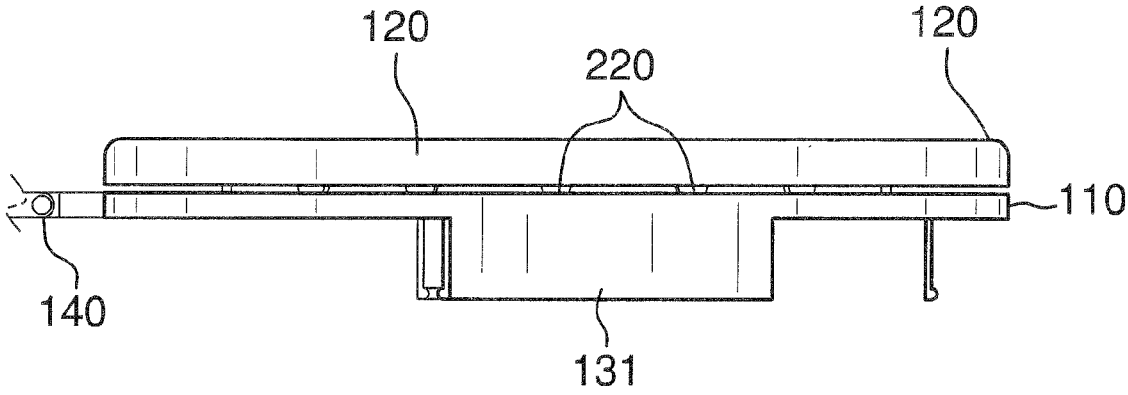
FIG. 6 is a side view of the toilet seat device of FIG. 1.

The following is a listing of numbers corresponding to a particular element refer to herein:

100 swiveling toilet seat device
101 toilet
105 toilet bowl
106 rim of toilet bowl
110 first base
115 back end of base
120 second base
131 first clamp
132 second clamp
140 hinge
210 track
220 wheel Referring now to FIGS. 1-6, the present invention features a swiveling toilet seat device 100. In some embodiments, the toilet seat device 100 of the present invention may provide comfort and convenience for elderly and/or disabled users. The toilet seat device 100 allows a user to twist and rotate if he/she sits on the toilet 101.

The toilet seat device 100 comprises a first base 110 in the shape of a standard toilet seat, well known to one of ordinary skill in the art. The first base 110 has a top surface and a bottom surface, the bottom surface for placing atop the rim 106 of a toilet bowl 105. The first base 110 may be pivotally attached to the rim 106 of the toilet bowl 105 via a hinge 140. For example, the hinge 140 may be disposed on the back end 115 of the first base 110 and attach to the back region of the rim 106 of the toilet bowl 105 (see FIG. 3). The hinge 140 may be similar to standard hinges used for toilet seats well known to one of ordinary skill in the art. The first base 110 may be pivoted upwardly and downwardly over the rim 106 of the toilet bowl 105 like standard toilet seats.

In some embodiments, the first base 110 may be secured to the rim 106 of the toilet bowl 105 via a first attachment means. The attachment means may include a first clamp 131 and/or a second clamp 132 (or a plurality of clamps) extending downwardly from the first base 110 and gripping the rim 106 of the toilet bowl 105. The first clamp 131 and/or second clamp 132 may extend from the outer edge of the first base 110 or from the inner edge of the first base 110 (see FIG. 4). The present invention is not limited to the aforementioned attachment means.

Disposed above the first base 110 (e.g., atop the top surface of the first base 110) is a second base 120. The second base 120 may also be shaped like a standard toilet seat. Extending from the bottom surface of the second base 120 is a plurality of wheels 220. The wheels 220 are attached generally perpendicularly in the second base 120 such that they can spin. The wheels 220 may be arranged in a circle or oval, in line with the shape of the second base 120 (see FIG. 4).

Disposed in the top surface of the first base 110 is a track 210 adapted for receiving the wheels 220 of the second base 120. The shape of the track 210 is such that the each wheel 220 can fit in the track 210 and allow the second base 120 to rotate in a first direction and a second direction (e.g., clockwise and counterclockwise). The track 210 may help keep the second base 120 secured atop the first base 110. In some embodiments, the wheels 220 are attached in a wheel track in the bottom surface of the second base 120.

In some embodiments, the first base 110 and/or the second base 120 are constructed from a material comprising a plastic, a metal, a wood, the like, or a combination thereof.

The following the disclosures of the following U.S. Patents are incorporated in their entirety by reference herein: U.S. Pat. No. 6,018,825; U.S. Pat. No. 4,080,671; U.S. Pat. No. 4,080,671; U.S. Pat. No. 6,868,561; U.S. Pat. No. 4,951,328; U.S. Pat. No. 7,155,748.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A swiveling toilet seat device for attaching to a rim of a toilet bowl, said toilet seat device consisting of:

(a) a toilet seat-shaped first base pivotally attached to a back region of the rim of the toilet bowl via a hinge;

(b) a toilet seat-shaped second base disposed atop the first base; wherein a plurality of wheels extend from a bottom surface of the second base and are arranged in a generally circular pattern around the second base;

(c) a track disposed in the top surface of the first base in a generally circular pattern corresponding to the wheels in the second base, wherein the track is adapted for receiving the wheels such that the second base can rotate in a first direction and a second direction atop the first base, wherein the shape of the track is such that the each wheel can fit in the track.

2. The toilet seat device of claim 1, wherein the first base is secured to the rim of the toilet bowl.

3. The toilet seat device of claim 1, wherein the first base and/or the second base are constructed from a material comprising a plastic, a metal, a wood, the like, or a combination thereof.

* * * * *